US006430754B1

(12) United States Patent
Taylor et al.

(10) Patent No.: US 6,430,754 B1
(45) Date of Patent: Aug. 13, 2002

(54) FIREFIGHTING GARMENT

(75) Inventors: Frank P. Taylor, Dayton; Donald Aldridge, New Carlisle, both of OH (US)

(73) Assignee: Lion Apparel, Inc., Dayton, OH (US)

( * ) Notice: Subject to any disclaimer, the term of this patent is extended or adjusted under 35 U.S.C. 154(b) by 0 days.

(21) Appl. No.: 09/517,919

(22) Filed: Mar. 3, 2000

(51) Int. Cl.[7] ..... A62B 17/00

(52) U.S. Cl. ..... 2/458; 2/81; 2/87; 2/93; 2/27

(58) Field of Search ..... 2/456, 181, 82, 2/85, 87, 93, 97, 272, 904

(56) References Cited

U.S. PATENT DOCUMENTS

| | | | | |
|---|---|---|---|---|
| 3,925,823 A | * | 12/1975 | Kupferman | 2/81 |
| 4,188,445 A | | 2/1980 | Hill | |
| 4,502,153 A | * | 3/1985 | Lapedes et al. | 2/81 |
| 4,583,247 A | | 4/1986 | Fingerhut et al. | |
| 4,696,066 A | | 9/1987 | Ball et al. | |
| 4,897,886 A | | 2/1990 | Grilliot et al. | |
| 4,922,552 A | | 5/1990 | Grilliot et al. | |
| 5,043,209 A | | 8/1991 | Boissé et al. | |
| 5,098,770 A | | 3/1992 | Paire | |
| 5,136,723 A | | 8/1992 | Aldridge et al. | 2/81 |
| 5,150,476 A | | 9/1992 | Statham et al. | |
| 5,189,737 A | | 3/1993 | Ribicic | |
| 5,236,769 A | * | 8/1993 | Paire | 428/196 |
| 5,399,418 A | | 3/1995 | Hartmanns et al. | |
| 5,447,787 A | | 9/1995 | Shaffer | |
| 5,468,537 A | | 11/1995 | Brown et al. | |
| 5,640,718 A | * | 6/1997 | Aldridge | 2/81 |
| 5,685,015 A | * | 11/1997 | Aldridge | 2/81 |
| 5,724,673 A | | 3/1998 | Aldridge | 2/81 |
| 5,727,401 A | | 3/1998 | Statham | |

(List continued on next page.)

FOREIGN PATENT DOCUMENTS

WO 99/38398 8/1999

OTHER PUBLICATIONS

International Search Report issued Aug. 30, 2001 in corresponding PCT International Application No. PCT/US01/07484.

Supplementary European Search Report regarding European Application No. 98941091 issued Mar. 12, 2001.

*Primary Examiner*—John J. Calvert
*Assistant Examiner*—Robert H. Muromoto, Jr.
(74) *Attorney, Agent, or Firm*—Thompwon Hine LLP

(57) ABSTRACT

A protective garment, such as a firefighting garment, that is relatively thin and light weight. The garment possesses relatively high resistance to liquid water absorption, yet also possesses relatively high moisture vapor transport characteristics when compared to conventional firefighting garments. The garment of the present invention includes an outer shell; a thermal liner positioned within the outer shell; a moisture barrier positioned within the thermal liner and a face cloth positioned within the moisture barrier. The thermal liner is batting, knit, spunlace, woven textile or other suitable construction of a high heat and flame resistant material (such as an aramid or PBI material, or combinations thereof) that is treated with a durable, water repellant finish to minimize liquid moisture absorption by the thermal liner. Despite the liquid moisture absorption resistance imparted onto the thermal liner by the finish, the thermal liner still retains excellent moisture vapor transport characteristics. By positioning the treated thermal liner between the outer shell and the moisture barrier, the moisture barrier is protected from damage due to excessive thermal heat from the ambient and from abrasion and wear caused by the outer shell. Additionally, by orienting the moisture barrier within the thermal barrier, the TPP (thermal protection property) of the garment is substantially increased. This allows for the reduction in the overall thickness and weight of the thermal liner throughout the garment.

44 Claims, 2 Drawing Sheets

U.S. PATENT DOCUMENTS 5,787,503 A 8/1998 Murphy, III
5,858,888 A 1/1999 Underwood et al.
5,860,163 A 1/1999 Aldridge ..... 2/81
5,920,905 A * 7/1999 Aldridge ..... 2/81
5,928,971 A 7/1999 Ellis et al.
5,965,223 A 10/1999 Andrews et al.
5,983,409 A * 11/1999 Aldridge et al. ..... 2/458
5,996,122 A * 12/1999 Aldridge et al. ..... 2/81
6,038,700 A * 3/2000 Aldridge et al. ..... 2/81

* cited by examiner

FIREFIGHTING GARMENT

BACKGROUND

The present invention relates to hazardous duty garments and, more particularly, to lightweight firefighting garments that protect a wearer from extreme ambient conditions.

Protective garments are designed to shield a wearer from a variety of environmental hazards, and firefighting garments are representative of such garments. A conventional firefighting ensemble comprises a turnout coat and pant, each of which includes an outer shell, a moisture barrier located within the outer shell, a thermal liner located within the moisture barrier and an innermost face cloth layer. The outer shell typically is constructed of an abrasion-, flame- and heat-resistant material such as a woven aramid material, typically NOMEX or KEVLAR (both are trademarks of E. I. DuPont de Nemours & Co., Inc.) or a polybenzamidazole such a PBI (a trademark of Celanese Corp.) fiber material. The moisture barrier typically includes a semipermeable membrane layer which is moisture vapor permeable but impermeable to liquid moisture, such as CROSSTECH (a trademark of W. L. Gore & Associates, Inc.). The membrane layer is bonded to a substrate of high flame- and heat-resistant material, such as an aramid or PBI material.

As defined in the N.F.P.A. Standard for Protective Ensemble for Structural Firefighting, 1997 ed., the firefighting garment will include three types of seams: Major A Seams, Major B Seams and Major Seams. Major A Seams are the outer shell layer seam assemblies where a rupture of the seam could reduce protection of the garment by exposing the inner layers of the garment (such as the moisture barrier or thermal liner), the wearer's station/work uniform, other clothing or skin. The Major A Seam must have a seam strength equal to or greater than 675 N (150 lbf). Major B Seams are moisture barrier or thermal barrier seam assemblies where a rupture of the seam could reduce protection of the garment by exposing the next inner layer of the garment, the wearer's station/work uniform, other clothing or skin. The Major B Seam must have a seam strength equal to or greater than 337.5 N (75 lbf). Major Seams are seam assemblies not classified as Major A or Major B Seams and must have a seam strength equal to or greater than 180 N (40 lbf).

The thermal liner is typically positioned within the moisture barrier in order to prevent the thermal liner from soaking up liquid moisture flowing through the outer shell from the ambient. The thermal liner typically comprises a layer of insulation material, such as a relatively thick layer of aramid fiber batting or needlepunch, which is often quilted to a lightweight aramid fabric substrate or face cloth. The batting of the thermal barrier traps air and possesses sufficient loft to provide the necessary thermal resistance, and the fabric substrate protects the batting of the thermal liner from abrasion from the wearer.

The aforementioned components typically are arranged within the garment so that the moisture barrier layer is positioned between the thermal liner and the outer shell. This is necessary to prevent the insulating material of the thermal liner from absorbing an excessive amount of liquid moisture from the ambient, which increases the overall weight of the garment and reduces breathability of the thermal liner, thereby increasing the stress imposed by the garment on the wearer, and reduces its loft and thermal resistance characteristics. However, one disadvantage with such an arrangement is that the laminated membrane of the moisture barrier is relatively delicate and can be damaged by heat, abrasion or puncture. Such damage results in increased exposure of the thermal liner to liquid moisture, which increases liquid moisture absorption.

Another disadvantage inherent in such an arrangement is that the moisture barrier layer adds to the bulk and weight of the garment and inhibits freedom of movement of the wearer, producing a "hobbling effect," increasing the stress imposed on the wearer in situations requiring high activity, and accelerates the onset of fatigue. Furthermore, with such an ensemble some perspiration from the wearer is absorbed by the thermal liner. Moreover, the combination of a discrete moisture barrier and thermal liner limits breathability, especially if the thermal liner is positioned within the moisture barrier.

Additionally, many conventional firefighting garments are designed such that their thermal liner, while positioned within the moisture barrier, actually promotes the absorption of fluids, such as a firefighter's perspiration. While such a garment may provide the firefighter short term comfort by keeping the firefighter's skin relatively dry, in the long term, such a thermal liner will tend to lose its insulating characteristics (much like a wet pot-holder) because moisture conducts heat energy better than air.

Accordingly, there is a need for a protective garment in which the susceptibility of the thermal liner to absorption of perspiration moisture and other moisture is minimized; a protective garment which is relatively thin and lightweight, yet provides adequate thermal protection; a protective garment which is inherently able to withstand a temperature of 500° F. for at least five minutes without igniting, melting or dripping, making it suitable for use as a firefighting garment; and a protective garment which minimizes the restriction of movement and hobbling effect characteristic of conventional firefighting garments.

SUMMARY

The present invention is a protective garment, such as a firefighting garment, that is relatively thin and light weight. The garment possesses relatively high resistance to liquid water absorption, yet also possesses high THL (Total Heat Loss) characteristics as tested with the guarded sweating hotplate test under the N.F.P.A. (National Fire Protection Association) 1971 Standard on Protective Ensemble for Fire Fighting, 2000 edition (higher THL translates into high moisture vapor transport characteristics). The garment of the present invention includes an outer shell; a thermal liner positioned within the outer shell; a moisture barrier positioned within the thermal liner and a face cloth positioned within the moisture barrier. The thermal liner is batting, knit, spunlace, woven textile or other suitable construction of a high heat and flame resistant material (such as an aramid or PBI material, or combinations thereof) that is treated with a durable, water repellant finish to minimize liquid moisture absorption by the thermal liner. Despite the liquid moisture absorption resistance imparted onto the thermal liner by the finish, the thermal liner still retains excellent moisture vapor transport characteristics. Suitable durable, water repellant finishes may be provided by treating the thermal liner with a commercially available perfluorohydrocarbon finish, such as TEFLON (a trademark of E. I. DuPont de Nemours & Co., Inc.) and/or SCOTCHGUARD (a trademark of Minnesota Mining & Manufacturing Company). By positioning the treated thermal liner between the outer shell and the moisture barrier, the moisture barrier is protected from damage due to excessive heat from the ambient and from abrasion and wear caused by the outer shell. Additionally, by orienting the moisture barrier within the thermal barrier, the TPP (thermal protection property) of the garment is substantially increased. This allows for the reduction in the overall thickness and weight of the thermal liner throughout the garment as will be seen in the several exemplary embodiments of the invention described herein.

One exemplary embodiment of the present invention is a protective garment, such as a firefighting garment, that includes an outer shell of abrasion, flame and heat resistant material; a thermal liner positioned within the outer shell that includes at least one layer of insulating material treated with a durable, water repellant finish; a moisture barrier positioned within the thermal barrier and a face cloth positioned within the moisture barrier. The thermal barrier may consist of one or more layers of high-heat resistant batting, spunlace or knit fabric material treated with a durable, water repellant finish; and in an exemplary embodiment, the thermal barrier consists of a first layer of high-heat resistant batting, spunlace or knit fabric material quilted or laminated to a second layer of high-heat resistant batting, spunlace or knit fabric material. Either or both of the layers of insulating material may be apertured.

In another exemplary embodiment of the present invention, a protective garment, such as a firefighting garment, includes an outer shell of abrasion, flame and heat-resistant material; at least one first layer of insulating material positioned within the outer shell; a moisture barrier layer positioned within the first layer of insulating material, at least one second layer of insulating material positioned within the moisture barrier, and a face cloth positioned within the second layer of insulating material. By "sandwiching" the moisture barrier between the at least two layers of insulating material, the total weight and/or thickness of the insulating material used throughout the garment can be substantially decreased and still meet the minimum TPP requirements of the relevant N.F.P.A. standard for firefighting garments. The first layer of insulating material is preferably a single layer of high heat- and flame-resistant woven textile material; or alternatively the first layer of insulating material may be an apertured or non-apertured spunlace, knit or batting of high heat- and flame resistant material. The second layer of insulating material is preferably a single layer of apertured high heat- and flame-resistant spunlace material; or alternatively the second layer of insulating material may be an apertured or non-apertured spunlace, knit or batting of high heat- and flame resistant material. Additionally, it is preferred that at least the first layer of insulating material is treated with a durable, water repellant finish as discussed above.

In another exemplary embodiment of the present invention, a protective garment, such as a firefighting garment, includes an outer shell of abrasion, flame and heat-resistant material, a thermal barrier/moisture barrier composite positioned between the outer shell and the wearer of the garment, where the thermal barrier/moisture barrier composite includes a substantially liquid-impermeable membrane bonded to one surface of a fabric substrate, and a first layer of insulating material attached to an opposite surface of the fabric substrate; and a thermal barrier/face cloth composite positioned between the thermal barrier/moisture barrier composite and the wearer, where the thermal barrier/face cloth composite includes a face cloth attached to a second layer of insulating material and where the face cloth faces the wearer of the garment. Preferably, the thermal barrier/moisture barrier composite is oriented such that the membrane faces the face cloth and such that the first layer of insulating material faces the outer shell. It is also preferred that the face cloth is stitched or quilted to the second layer of insulating material. Again, because of this exemplary embodiment essentially "sandwiches" a moisture barrier between a pair of thermal barriers, the overall thickness and/or weight of the insulating materials making up the thermal barriers can be decreased. Accordingly, it is preferred that the first layer of insulating material may be a woven textile material, while the second layer of insulating material is an apertured or non-apertured spunlace, knit or batting material. Additionally, it is preferred that at least the first layer of insulating material is treated with a durable, water repellent finish.

Accordingly, it is an object of the present invention to provide a protective garment in which the thermal liner absorbs a minimal amount of liquid moisture; a protective garment in which the moisture barrier is positioned within the thermal barrier of the garment; a protective garment in which the moisture barrier is sandwiched by a pair of thermal barriers; a protective garment which reduces the amount of moisture absorbed by the thermal liner; a protect garment which is relatively thin and light weight, thereby minimizing the bulk and reducing the hobbling effect of such a garment, and also reducing material costs of the garment; and a protective garment that enhances the transport of moisture vapor there through for breathability and greater cooling (higher THL characteristics).

It is also an object of the present invention to provide a firefighting garment having an outer shell of abrasion, flame and heat resistant material, and a liner positioned within the outer shell; where the liner includes a substrate layer of high heat- and flame-resistant material bonded to a layer of substantially liquid-impermeable membrane material on one side and attached to a layer of high heat- and flame-resistant insulating material on an opposite side via a sewn and sealed Major B Seam.

It is a further object of the present invention to provide a hazardous duty garment having an outer shell of abrasion, flame and heat resistant material, and a liner positioned within the outer shell; where the liner includes a substrate layer of high heat- and flame-resistant material bonded to a layer of substantially liquid-impermeable membrane material on one side and attached to a layer of face cloth material on an opposite side via a sewn and sealed Major B Seam.

Other objects and advantages of the present invention will be apparent from the following description, the accompanying drawings and the appended claims.

DETAILED DESCRIPTION

The present invention is a protective garment, such as a firefighting garment, that is relatively thin and light weight. The garment possesses relatively high resistance to liquid water absorption, yet also possesses relatively high moisture vapor transport characteristics when compared to conventional firefighting garments. The garment of the present invention includes an outer shell; a thermal liner positioned within the outer shell; a moisture barrier positioned within the thermal liner and a face cloth positioned within the moisture barrier. The thermal liner is an apertured or non-apertured batting, knit, spunlace, woven textile or other suitable construction of a high heat- and flame-resistant material (such as an aramid or PBI material, or combinations thereof) that is treated with a durable, water repellant finish to minimize liquid moisture absorption by the thermal liner. Despite the liquid moisture absorption resistance imparted onto the thermal liner by the finish, the thermal liner still retains excellent moisture vapor transport characteristics (high THL characteristics).

A suitable durable, water repellant finishes may be provided by treating the thermal liner with a commercially available perfluorohydrocarbon finish, such as TEFLON (a trademark of E. I. DuPont de Nemours & Co., Inc.) and/or SCOTCHGUARD (a trademark of Minnesota Mining & Manufacturing Company). Preferably, a loading of at least 2.5% on weight of fabric of TEFLON is used. A commercially available method for finishing the relevant components of the garment with TEFLON Fabric Protector is provided by E. I DuPont de Nemours & Co., Inc. of Wilmington, Del., 19898.

By positioning the treated thermal liner between the outer shell and the moisture barrier, the moisture barrier is protected from damage due to excessive heat from the ambient transmitted through the outer shell and from abrasion and wear caused by the outer shell. Additionally, by orienting the moisture barrier within the thermal barrier, the TPP (Thermal Protection Performance) of the garment is substantially increased. This allows for the reduction in the overall thickness and/or weight of the thermal liner throughout the garment as will be seen in the several exemplary embodiments of the invention described herein.

Figure 1:
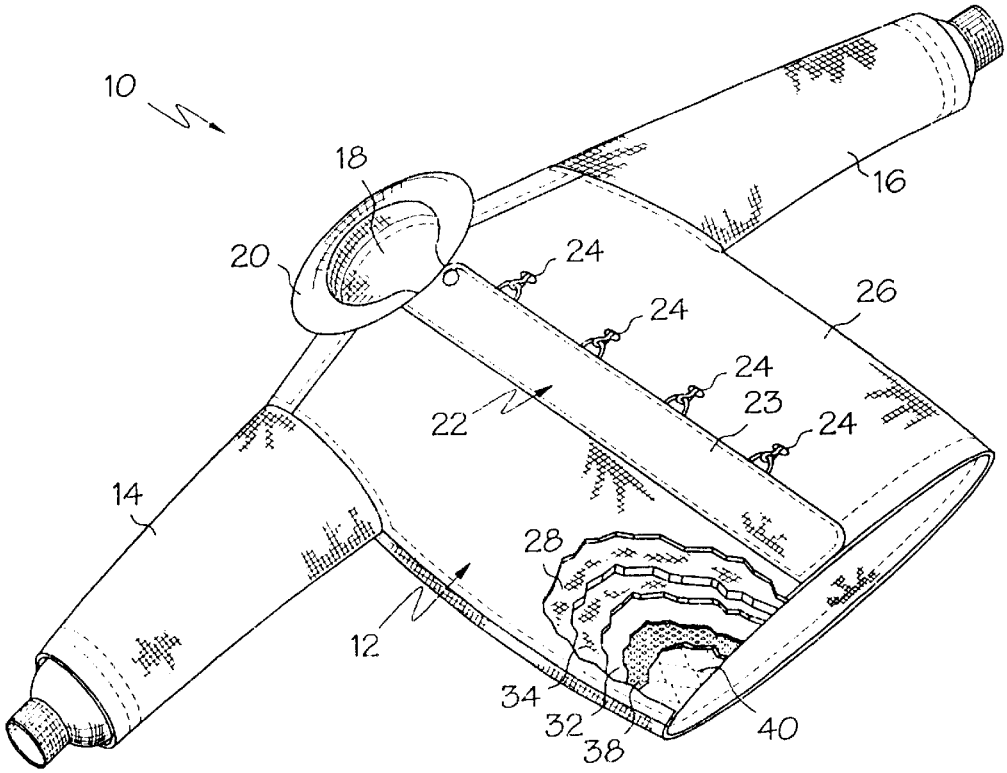
FIG. 1 is a somewhat schematic, perspective view of a firefighting garment incorporating an exemplary embodiment of the present invention.

As shown in FIG. 1, an exemplary embodiment of the present invention is a protective garment in the form of a firefighter garment, generally designated 10. It is to be understood that the present invention is not limited to firefighter garments, but can be incorporated into work garments and other hazardous duty garments, such as brush fire and EMS garments, in both coat and pant combinations and "jumpsuit" styles, without departing from the scope of the invention. The garment 10 illustrated in FIG. 1 is a firefighter turn-out coat having a body portion 12, sleeves 14, 16, a neck opening 18, a collar 20 surrounding the neck opening, and a front closure, generally designated 22. The front closure 22 is of a conventional design and includes a storm flap 23. The closure 22 is secured by snaps, or alternatively, strips of hook and loop fastener material (not shown) in combination with mechanical locking means such as hook and "D" combinations 24 extending between the flap 23 and the body portion 12, or a slide fastener (not shown).

Figure 2:
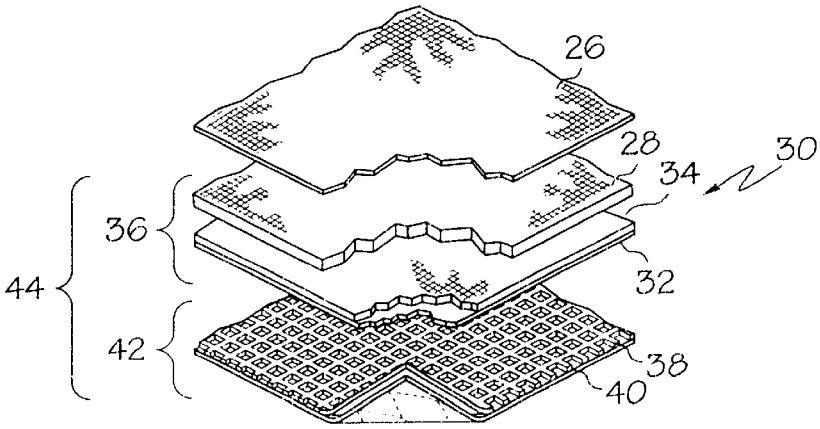
FIG. 2 is an exploded, perspective view of a section of a detail of a garment of FIG. 1.

As shown in FIGS. 1 and 2, the garment 10 includes an abrasion, heat and flame resistant outer shell, generally designated 26, which covers substantially the entire outer surface of the garment. The outer shell 26 is a compact weave of an aramid material such as NOMEX or KEVLAR, a blend of such aramid materials, a PBI material, or a blend of aramid and PBI materials. Preferably, the outer shell 26 is treated with a durable, water repellant finish. A first layer of insulating material 28 is positioned immediately within the outer shell and extends substantially throughout the garment 10. The layer of insulating material 28 is preferably a woven fabric of aramid or PBI (or combinations thereof) spun yarn that is treated with a durable, water repellant finish such as TEFLON and/or SCOTCHGUARD. Such a material is commercially available from Safety Components Fabric Technologies Inc., as "Chambray" cloth. The Chambray cloth material has a weight of approximately 3.20 osy, but it is within the scope of the invention to provide other high heat- and flame resistant woven materials, preferably having a weight of approximately 2.0 osy to approximately 6.0 osy. For example, it is within the scope of the present invention to replace the "Chambray" cloth with a 4.50 osy or 6.00 osy NOMEX/BASOFIL (approx. 60%/40%) blend cloth commercially available from Milliken & Co. (BASOFIL is a trademark of BASF Corp.). It is also within the scope of the invention that the cloth of the first insulating layer 28 be a "slick" cloth woven from a high heat- and flame-resistant filament yarn so as to impart a degree of lubricity between the insulating layer 28 and the outer shell 26. An example of such a "slick" cloth is a "Glide II" face cloth commercially available from Safety Components Fabric Technologies, Inc.

Positioned immediately within the first insulating layer 28 is a moisture barrier 30 that extends substantially throughout the garment 10. The moisture barrier 30 includes a semi-permeable membrane layer 32 that is moisture vapor permeable but impermeable to liquid moisture, such as CROSSTECH, laminated to a substrate 34 of flame- and heat-resistant material, such as an aramid or PBI (or combinations thereof) material. A well known suitable example of such a substrate material 34 includes a pajama check weave NOMEX material. Other suitable examples of the substrate material 34 include an Araflo E-89 or a PTFE Vilene material. The moisture barrier 30 is preferably oriented such that the semi-permeable membrane 32 faces a wearer of the garment. It is also preferred that the first insulating layer 28 and the moisture barrier 30 are combined via a sewn and sealed Major B Seam, thus providing a combination thermal barrier/moisture barrier component 36. Sealing the Major B Seam, as known to those of ordinary skill in the art, involves the application of a sealing tape (commercially available from W. L Gore & Associates) to the seams to prevent the transport of fluid through the holes punched in the membrane layer 32 by stitching.

Positioned immediately within the moisture barrier 30 is a second layer of insulating material 38, which is preferably a single layer of approximately 1.5 osy apertured Araflo E-89 spunlace material, commercially available from E. I. DuPont de Nemours & Co. It is also within the scope of the invention that the insulating layer 38 can be an apertured or non-apertured batting, knit, spunlace or other suitable construction of a high heat- and flame-resistant material (such as an aramid or PBI material, or combinations thereof). This second insulating layer 38 extends substantially throughout the garment 10. Positioned immediately within the second layer of insulating material 38 is a face cloth 40, preferably woven from a filament yarn so as to provide a degree of lubricity between the garment 10 and a wearer of the garment. An example of a "slick" face cloth material for use as the face cloth 40 is a "Glide II" face cloth commercially available from Safety Components Fabric Technologies Inc. The face cloth 40 also extends substantially throughout the entire garment 10. The second insulating layer 38 and the face cloth 40 are preferably quilted together to form a combination thermal barrier/face cloth 42.

The combination thermal barrier/moisture barrier 36 and the combinations thermal barrier/face cloth 42 are bound together to form a liner 44 that is received within the outer shell 26. It has been found that by "sandwiching " the moisture barrier 30 between the two layers of insulating material 28, 38, the overall combined thickness and weight of insulating material used in the liner 44 can be significantly decreased while still maintaining adequate TPP ratings under the N.F.P.A. 1971 standard and exceptional moisture vapor transport characteristics. For example, the above preferred construction of this liner 44 (including the Chambray layer 28, the Crosstech-PJC layer 30, the E-89 apertured Araflo layer 38 and the Glide II layer 40) has a nominal thickness of approximately 80 mils±5 mils and a nominal weight of approximately 13.1 osy. Accordingly, this preferred embodiment of the liner 44 is significantly thin in comparison to conventional firefighting garment liners, yet maintaining adequate TPP ratings and exceptional moisture vapor transport characteristics.

Figure 3:
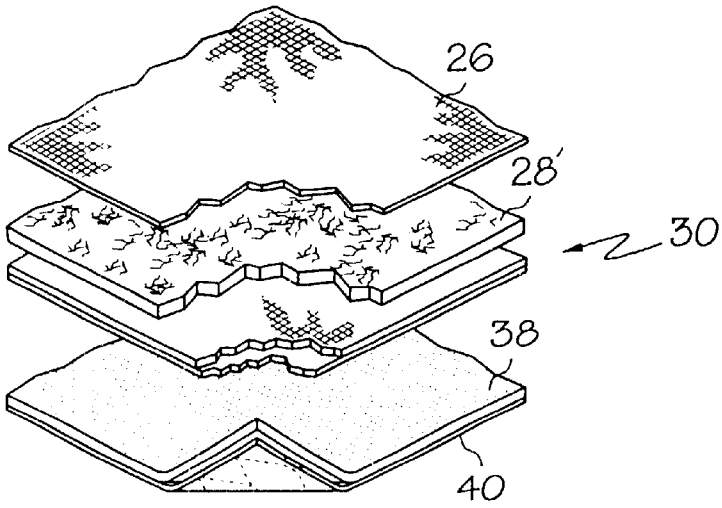
FIG. 3 is an exploded, perspective view of a detail of another exemplary embodiment of the present invention.

Alternatively, this invention also provides for a substantial increase in TPP ratings for a protective garment if the combined thickness and weight of insulating material is increased to be consistent with, or slightly less than that of conventional firefighting garments. For example, as shown in FIG. 3, by replacing the woven spun yard fabric with a thicker batting 28' of high heat- and flame-resistant material, treated with a durable, water repellant finish, the TPP ratings of the garment are increased significantly while maintaining a substantially thin and light weight liner 44 and overall garment. Of course, it is also within the scope of the invention that the insulating layer 28' be constructed from other suitable layer(s) of high heat- and flame-resistant, apertured or non-apertured, knit, spunlace or bats that have been treated with a durable, water repellant finish.

In an alternate construction of the garments of FIGS. 2 and 3, the layer(s) of insulating material 28, 28' could be attached to the outer shell 26 via a Major A Seam; the orientation of the moisture barrier 30 can be reversed (such that the membrane 32 faces away from a wearer of the garment); and the moisture barrier 30, second insulating layer(s) 38 and face cloth 40 can be attached together via a sewn and sealed Major B Seam to form a discrete liner.

Figure 4:
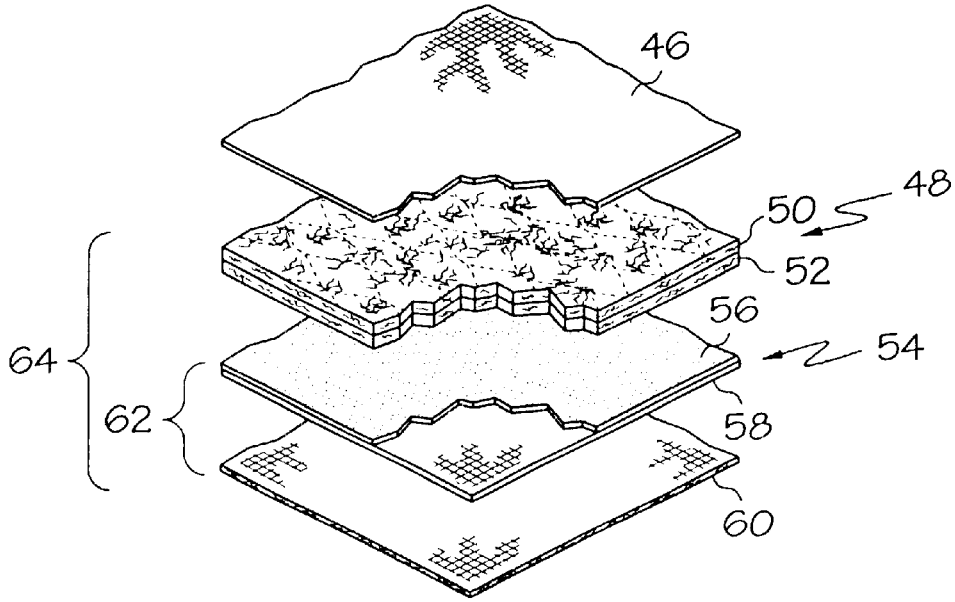
FIG. 4 is an exploded, perspective view of a detail of yet another exemplary embodiment of the present invention.

As shown in FIG. 4, an alternate exemplary embodiment of the present invention includes an outer shell 46 of abrasion, heat and flame resistant material that covers substantially the entire outer surface of the garment 10. Immediately within the outer shell is a thermal barrier 48, extending substantially throughout the garment 10, that consists of a first layer 50 of high heat- and flame-resistant insulating material quilted to a second layer 52 of high heat- and flame-resistant insulating material. Preferably, the first layer 50 is a 2.3 osy E-89 spunlace non-woven material and the second layer 52 is an apertured 1.5 osy Araflo E-89 spunlace non-woven material. Each of these layers 50, 52 are treated with a durable, water repellent finish such as TEFLON and/or SCOTCHGUARD. It is noted that the quilting of the two layers 50, 52 together substantially alleviates the necessity for an additional protective face cloth stitched to the layers of insulating material. Alternatively, the first and second layers 50, 52 may be layers of 0.9 osy NOMEX E-88 spunlace non-woven materials that are laminated together by an adhesive. It is noted that in this alternate construction of the thermal barrier 48, the resultant laminate composite provides additional strength and thermal protection performance vs. a single layer of batting. Additionally, this lamination of the two layers will help protect the thermal liner 48 from wear and abrasion caused by the outer shell 46. It is to be understood that in this alternate construction of the thermal barrier, both layers of the insulating material are also treated with the durable, water repellant finish.

Positioned immediately within the thermal barrier 48 is a moisture barrier 54 extending substantially throughout the garment, which includes a semi permeable membrane layer 56 laminated or bonded to a substrate 58 of flame- and heat-resistant material. The moisture barrier is oriented such that the semi permeable membrane 56 faces outwardly away from a wearer of the garment. Positioned immediately within the moisture barrier 54 is a "slick" face cloth 60 extending substantially throughout the garment. The moisture barrier 54 and the face cloth 60 are preferably combined via a sewn and sealed Major B Seam to provide a combination moisture barrier/face cloth 62. The combination moisture barrier/face cloth 62 is bound together with the thermal barrier 48 to form a liner 64 that is positioned within the outer shell 46.

The above preferred construction of this liner 64 (including the two quilted layers of apertured 1.5 osy Araflo E89 and non-apertured 2.3 osy Araflo 50, 52, the Crosstech-PJC layer 30, and the Glide II layer 40) has a nominal thickness of approximately 96 mils and a nominal weight of approximately 12.2 osy.

It is to be understood that the thermal barrier 48 can be constructed from other insulating materials such as one or more layers, or combinations of layers, of apertured or non-apertured non-woven, spunlace, woven or knitted high heat- and flame-resistant material that is treated with a durable, water repellant finish. For example, it is within the scope of the invention that the thermal barrier 48 be constructed from a layer of Chambray face cloth quilted to a layer of Araflo E-89 spun-lace non-woven insulating material (having a combined nominal weight of approximately 4.7 osy and combined nominal thickness of approximately 51 mils).

It is also within the scope of the invention to utilize a thermal liner that includes a layer of apertured, closed cell foam as described in U.S. Pat. No. 5,924,134, the disclosure of which is enclosed herein by reference. Such a thermal liner does not absorb significant amounts of liquid moisture and can be made thinner than conventional thermal liners, yet still meets the overall thermal requirements for firefighting garments.

The moisture barriers 30, 54 discussed above can also be constructed from a semipermeable membrane laminated to a non-woven spunlace having a nominal weight of approximately 4.0 osy and a nominal thickness of approximately 30 mils. Such a moisture barrier would allow the insulating layers of the various embodiments to be even thinner and possibly lighter.

In an alternative construction of the embodiment of FIG. 4, the layer(s) of insulating material of the thermal barrier 48 may be attached to the outer shell 46 via a Major A Seam, and the combination moisture barrier/face cloth 62 would thus provide the liner of the garment.

It is to be understood that the embodiments of the firefighting garments described above in FIGS. 1–4 meet the NFPA 1971 standard. In particular, each garment resists igniting, melting or dripping when exposed to 500° F. for at least 5 minutes; each garment passes the liquid penetration test and each garment passes all other tests comprising the standard.

While the forms of apparatus herein described constitute the preferred embodiments of the present invention, it is to be understood that the invention is not limited to these precise forms of apparatus and that changes may be made therein without departing from the scope of the invention.

What is claimed is:

1. A protective garment comprising:

an outer shell of an abrasion, flame and heat resistant material;

a thermal barrier/moisture barrier composite positioned between the outer shell and a wearer of the garment, the thermal barrier/moisture barrier composite including a substantially liquid-impermeable membrane bonded to one surface of a heat and flame resistant fabric substrate, and a first layer of heat and flame resistant insulating material treated with a durable, water repellant finish and attached to an opposite surface of the fabric substrate; and a face cloth positioned between the thermal barrier/moisture barrier composite and a wearer of the garment.

2. The protective garment of claim 1, wherein the thermal barrier/moisture barrier composite is oriented such that the membrane faces a wearer of the garment and such that the first layer of insulating material faces the outer shell.

3. A protective garment comprising:

an outer shell of an abrasion, flame and heat resistant material;

a thermal barrier/moisture barrier composite positioned between the outer shell and a wearer of the garment, the thermal barrier/moisture barrier composite including a substantially liquid-impermeable membrane bonded to one surface of a heat and flame resistant fabric substrate, and a first layer of heat and flame resistant insulating material treated with a durable, water repellant finish and attached to an opposite surface of the fabric substrate; and a face cloth positioned between the thermal barrier/moisture barrier composite and a wearer of the garment;

wherein the thermal barrier/moisture barrier composite is oriented such that the membrane faces a wearer of the garment and such that the first layer of insulating material faces the outer shell; and wherein the face cloth is attached to a second layer of insulating material, the second layer of heat and flame resistant insulating material facing the thermal barrier/moisture barrier composite.

4. The protective garment of claim 3, wherein the face cloth is woven from a filament yarn.

5. The protective garment of claim 4, wherein the first layer of insulating material is a non-woven batting material.

6. The protective garment of claim 5, wherein the second layer of insulating material is a non-woven batting material.

7. The protective garment of claim 4, wherein the first layer of insulating material is a woven textile.

8. The protective garment of claim 7, wherein the second layer of insulating material is a non-woven batting material.

9. A protective garment comprising:

an outer shell of an abrasion, flame and heat resistant material;

a thermal barrier/moisture barrier composite positioned between the outer shell and a wearer of the garment, the thermal barrier/moisture barrier composite including a substantially liquid-impermeable membrane bonded to one surface of a heat and flame resistant fabric substrate, and a first layer of heat and flame resistant insulating material treated with a durable, water repellant finish and attached to an opposite surface of the fabric substrate; and a face cloth positioned between the thermal barrier/moisture barrier composite and a wearer of the garment;

wherein the thermal barrier/moisture barrier composite is oriented such that the membrane faces a wearer of the garment and such that the first layer of insulating material faces the outer shell;

wherein the face cloth is attached to a second layer of insulating material, the second layer of heat and flame resistant insulating material facing the thermal barrier/moisture barrier composite;

wherein the first layer of insulating material has a nominal weight of approximately 2.0 to approximately 6.0 osy and a nominal thickness of approximately 10 to 70 mils; and wherein the second layer of insulating material has a nominal weight of approximately 0.9 to approximately 3.0 osy and a nominal thickness of approximately 10 to 70 mils.

10. A protective garment comprising:

an outer shell of an abrasion, flame and heat resistant material;

a thermal barrier/moisture barrier composite positioned between the outer shell and a wearer of the garment, the thermal barrier/moisture barrier composite including a substantially liquid-impermeable membrane bonded to one surface of a heat and flame resistant fabric substrate, and a first layer of heat and flame resistant insulating material treated with a durable, water repellant finish and attached to an opposite surface of the fabric substrate; and a face cloth positioned between the thermal barrier/moisture barrier composite and a wearer of the garment;

wherein the first layer of insulating material is attached to the fabric substrate via a sewn and sealed Major B Seam.

11. A protective garment comprising:

an outer shell of an abrasion, flame and heat resistant material;

a thermal barrier/moisture barrier composite positioned between the outer shell and a wearer of the garment, the thermal barrier/moisture barrier composite including a substantially liquid-impermeable membrane bonded to one surface of a heat and flame resistant fabric substrate, and a first layer of heat and flame resistant insulating material attached to an opposite surface of the fabric substrate;

a face cloth positioned between the thermal barrier/moisture barrier composite and a wearer of the garment; and a second layer of heat and flame resistant insulating material attached to the face cloth and positioned between the thermal barrier/moisture barrier composite and the face cloth.

12. The protective garment of claim 11, wherein the first layer of insulating material is a woven textile and the second layer of insulating material is an apertured or non-apertured, knit, spunlace or batting material.

13. The protective garment of claim 12, wherein the thermal barrier/moisture barrier composite is oriented such that the membrane faces a wearer of the garment and such that the first layer of insulating material faces the outer shell.

14. The protective garment of claim 11, wherein the face cloth is woven from a heat and flame resistant filament yarn.

15. The protective garment of claim 14, wherein the face cloth is quilted to the second layer of insulating material.

16. A protective garment comprising:

an outer shell of an abrasion, flame and heat resistant material;

a thermal barrier/moisture barrier composite positioned between the outer shell and a wearer of the garment, the thermal barrier/moisture barrier composite including a substantially liquid-impermeable membrane bonded to one surface of a heat and flame resistant fabric substrate, and a first layer of heat and flame resistant insulating material attached to an opposite surface of the fabric substrate;

a face cloth positioned between the thermal barrier/moisture barrier composite and a wearer of the garment; and a second layer of heat and flame resistant insulating material attached to the face cloth and positioned between the thermal barrier/moisture barrier composite and the face cloth;

wherein the first layer of insulating material is attached to the fabric substrate via a sewn and sealed Major B Seam.

17. A firefighting garment comprising:

an outer shell;

a thermal barrier/moisture barrier composite positioned between the outer shell and a wearer of the garment, the thermal barrier/moisture barrier composite including a substantially liquid-impermeable membrane bonded to one surface of a fabric substrate, and a first layer of insulating material attached to an opposite surface of the fabric substrate; and a face cloth positioned between the thermal barrier/moisture barrier composite and a wearer of the garment;

the thermal barrier/moisture barrier composite being oriented such that the membrane faces a wearer of the garment and such that the first insulating layer faces the outer shell.

18. The firefighting garment of claim 17, wherein the first layer of insulating material is a non-woven batting treated with a durable, water-repellant finish.

19. The firefighting garment of claim 17, wherein the first layer of insulating material is a woven textile treated with a durable, water-repellant finish.

20. The firefighting garment of claim 17, further comprising a second insulating layer positioned between the thermal barrier/moisture barrier composite and the face cloth.

21. The firefighting garment of claim 20, wherein the face cloth is woven from a filament yarn.

22. A protective garment comprising:

an outer shell of an abrasion, flame and heat resistant material;

at least one first layer of insulating material positioned between the outer shell and a wearer of the garment;

a moisture barrier layer positioned between the first layer of insulating material and a wearer of the garment;

at least one second layer of insulating material positioned between the moisture barrier and a wearer of the garment; and a face cloth positioned between the second layer of insulating material and a wearer of the garment;

wherein the first layer of insulating material and the moisture barrier are hung via a sewn and sealed Major B Seam to provide a combination moisture barrier/thermal barrier; and wherein the second layer of insulating material is quilted to the face cloth to provide a combination face cloth/thermal barrier.

23. The protective garment of claim 22 wherein the second layer of insulating material is taken from a group consisting of one or more layers of, or a combination of layers of: a heat and flame resistant woven textile, an apertured spunlace non woven heat and flame resistant material, an apertured knit heat and flame resistant material, an apertured heat and flame resistant batting, a non-apertured spunlace non woven heat and flame resistant material, a non-apertured knit heat and flame resistant material, and a non-apertured heat and flame resistant batting.

24. The protective garment of claim 23 wherein the face cloth is woven from a filament yarn material to provide a degree of lubricity between the face cloth and a wearer of the garment.

25. The protective garment of claim 23 wherein the moisture barrier is an aramid fabric substrate coated on at least one side with a substantially liquid-impermeable membrane, and wherein the membrane faces towards a wearer of the garment.

26. The protective garment of claim 22 wherein the first layer of insulating material is taken from a group consisting of one or more layers of, or a combination of layers of: a heat and flame resistant woven textile, an apertured spunlace non woven heat and flame resistant material, an apertured knit heat and flame resistant material, an apertured heat and flame resistant batting, a non-apertured spunlace non woven heat and flame resistant material, a non-apertured knit heat and flame resistant material, and a non-apertured heat and flame resistant batting.

27. The protective garment of claim 22 wherein the combination moisture barrier/thermal barrier and the combination face cloth/thermal barrier are bound together to form a discrete liner that is received within the outer shell.

28. A protective garment comprising:

an outer shell of an abrasion, flame and heat resistant material;

at least one first layer of insulating material positioned between the outer shell and a wearer of the garment;

a moisture barrier layer positioned between the first layer of insulating material and a wearer of the garment;

at least one second layer of insulating material positioned between the moisture barrier and a wearer of the garment; and a face cloth positioned between the second layer of insulating material and a wearer of the garment;

wherein the first layer of insulating material is attached to the outer shell via a Major A Seam; and wherein the second layer of insulating material and the face cloth are attached to the moisture barrier layer via a sewn and sealed Major B Seam.

29. A protective garment comprising:

an outer shell of an abrasion, flame and heat resistant material;

a thermal barrier positioned between the outer shell and a wearer of the garment, the thermal barrier including at least one layer of heat and flame resistant insulating material treated with a durable, water-repellant finish;

a moisture barrier positioned between the layer thermal barrier and a wearer of the garment; and a face cloth positioned between the moisture barrier and a wearer of the garment;

wherein the thermal barrier consists of one or more layers of high heat resistant woven textile, batting, spunlace or knit fabric material, or combinations thereof, treated with a durable, water repellant finish; and wherein the thermal barrier consists of a first layer of aramid spunlace non woven quilted to a second layer of aramid spunlace non woven.

30. A protective garment comprising:

an outer shell of an abrasion, flame and heat resistant material;

a thermal barrier positioned between the outer shell and a wearer of the garment, the thermal barrier including at least one layer of heat and flame resistant insulating material treated with a durable, water-repellant finish;

a moisture barrier positioned between the layer thermal barrier and a wearer of the garment;

a face cloth positioned between the moisture barrier and a wearer of the garment; and a second thermal barrier positioned between the face cloth and the moisture barrier.

31. A protective garment comprising:

an outer shell of an abrasion, flame and heat resistant material;

a thermal barrier positioned between the outer shell and a wearer of the garment, the thermal barrier including at least one layer of heat and flame resistant insulating material treated with a durable, water-repellant finish;

a moisture barrier positioned between the layer thermal barrier and a wearer of the garment; and a face cloth positioned between the moisture barrier and a wearer of the garment;

wherein the moisture barrier is an aramid fabric substrate coated on at least one side with a substantially liquid-impermeable membrane, and wherein the membrane faces away from a wearer of the garment;

wherein the moisture barrier and face cloth are hung via a sewn and sealed Major B Seam to provide a combination moisture barrier/face cloth; and wherein the combination moisture barrier/face cloth and the thermal barrier are bound together to form a discrete liner that is received within the outer shell.

32. A protective garment comprising:

an outer shell of an abrasion, flame and heat resistant material;

a thermal barrier positioned between the outer shell and a wearer of the garment, the thermal barrier including at least one layer of heat and flame resistant insulating material treated with a durable, water-repellant finish;

a moisture barrier positioned between the layer thermal barrier and a wearer of the garment; and a face cloth positioned between the moisture barrier and a wearer of the garment;

wherein the moisture barrier is an aramid fabric substrate coated on at least one side with a substantially liquid-impermeable membrane, and wherein the membrane faces away from a wearer of the garment;

wherein the protective garment further comprises a second thermal barrier attached to the face cloth between the face cloth and the moisture barrier to provide a combination thermal barrier/face cloth;

wherein the moisture barrier and first thermal barrier are hung via a sewn and sealed Major B Seam to provide a combination thermal barrier/moisture barrier; and wherein the combination thermal barrier/moisture barrier and the combination thermal barrier/face cloth are bound together to form a discrete liner that is received within the outer shell.

33. The protective garment of claim 30, wherein:

the moisture barrier and face cloth are attached via a sewn and sealed Major B Seam to provide a liner for the garment; and the thermal barrier is attached to the outer shell via a sewn Major A Seam.

34. The protective garment of claim 10, wherein the thermal barrier/moisture barrier composite is oriented such that the membrane faces a wearer of the garment and such that the first layer of insulating material faces the outer shell.

35. The protective garment of claim 34, wherein the face cloth is attached to a second layer of insulating material, the second layer of heat and flame resistant insulating material facing the thermal barrier/moisture barrier composite.

36. The protective garment of claim 35, wherein the face cloth is woven from a filament yarn.

37. The protective garment of claim 36, wherein the first layer of insulating material is a non-woven batting material.

38. The protective garment of claim 37, wherein the second layer of insulating material is a non-woven batting material.

39. The protective garment of claim 36, wherein the first layer of insulating material is a woven textile.

40. The protective garment of claim 39, wherein the second layer of insulating material is a non-woven batting material.

41. The protective garment of claim 28 wherein the first layer of insulating material is taken from a group consisting of one or more layers of, or a combination of layers of: a heat and flame resistant woven textile, an apertured spunlace non woven heat and flame resistant material, an apertured knit heat and flame resistant material, an apertured heat and flame resistant batting, a non-apertured spunlace non woven heat and flame resistant material, a non-apertured knit heat and flame resistant material, and a non-apertured heat and flame resistant batting.

42. The protective garment of claim 41 wherein the second layer of insulating material is taken from a group consisting of one or more layers of, or a combination of layers of: a heat and flame resistant woven textile, an apertured spunlace non woven heat and flame resistant material, an apertured knit heat and flame resistant material, an apertured heat and flame resistant batting, a non-apertured spunlace non woven heat and flame resistant material, a non-apertured knit heat and flame resistant material, and a non-apertured heat and flame resistant batting.

43. The protective garment of claim 42 wherein the face cloth is woven from a filament yarn material to provide a degree of lubricity between the face cloth and a wearer of the garment.

44. The protective garment of claim 42 wherein the moisture barrier is an aramid fabric substrate coated on at least one side with a substantially liquid-impermeable membrane, and wherein the membrane faces towards a wearer of the garment.

* * * * *